US011731298B1

(12) United States Patent
Pitts

(10) Patent No.: US 11,731,298 B1
(45) Date of Patent: Aug. 22, 2023

(54) HAIR STYLING TOOL DEVICE

(71) Applicant: Bobby Pitts, Fort Lauderdale, FL (US)

(72) Inventor: Bobby Pitts, Fort Lauderdale, FL (US)

( * ) Notice: Subject to any disclaimer, the term of this patent is extended or adjusted under 35 U.S.C. 154(b) by 0 days.

(21) Appl. No.: 17/163,852

(22) Filed: Feb. 1, 2021

Related U.S. Application Data

(60) Provisional application No. 62/968,871, filed on Jan. 31, 2020.

(51) Int. Cl.
*B26B 21/12* (2006.01)
*B26B 21/52* (2006.01)
*A45D 24/36* (2006.01)

(52) U.S. Cl.
CPC ..... *B26B 21/12* (2013.01); *B26B 21/525* (2013.01); *A45D 24/36* (2013.01); *B26B 21/522* (2013.01)

(58) Field of Classification Search
CPC ..... B26B 21/08; B26B 21/10; B26B 21/12; B26B 21/125; B26B 21/52; B26B 21/522; B26B 21/523; B26B 21/525
USPC ..... 30/30, 53–55
See application file for complete search history.

(56) References Cited

U.S. PATENT DOCUMENTS 770,767 A * 9/1904 Mihills ..... B26B 21/10 30/54
1,390,277 A * 9/1921 Davidson ..... B26B 21/10 30/54
1,448,205 A * 3/1923 Fuller ..... B26B 21/08 30/53
1,660,281 A * 2/1928 Vlazny ..... B26B 21/08 30/32
1,806,087 A * 5/1931 Schick ..... B26B 21/10 30/40.2
1,869,504 A * 8/1932 Priori ..... B26B 21/10 30/55
1,932,458 A * 10/1933 Hanson ..... B26B 21/10 30/55
1,987,514 A * 1/1935 Marusich ..... B26B 21/08 30/32
2,064,878 A * 12/1936 Birrell ..... B26B 21/10 30/55
2,315,297 A * 3/1943 Tischler ..... B26B 21/10 30/32
D159,994 S * 9/1950 Lee ..... 30/30
(Continued)

FOREIGN PATENT DOCUMENTS

DE 202015002864 U1 * 6/2015 ..... B26B 21/10

*Primary Examiner* — Jason Daniel Prone
(74) *Attorney, Agent, or Firm* — David P. Lhota, Esq.; Lhota & Associates, P.A.

(57) ABSTRACT

A hair design tool device having a handle, razor cartridge saddle and razor cartridge wherein the handle has a channel defining a closed edge and open edge defining a saddle sleeve for receiving the saddle in the closed position wherein the saddle is pivotally connected to the handle. The saddle defines a closed edge that mates with the handle channel and a channel for slidably receiving the razor cartridge which supports a razor and has a plurality of spaced prongs to define razor access openings with the edge of the razor being recessed in the frame for preventing inadvertent contact with the head or fingers. The razor cartridge may extend past the free end of the saddle for cutting thin strands of hair without pushing adjacent strands of hair. The handle may be fixed wherein the razor cartridge extends out one or both ends.

13 Claims, 9 Drawing Sheets

(56) References Cited

U.S. PATENT DOCUMENTS 2,530,918 A * 11/1950 Taylor ..... B26B 21/125 30/30
2,704,886 A * 3/1955 Finelli ..... B26B 21/12 30/54
2,780,865 A * 2/1957 Ferrer ..... B26B 21/10 30/53
2,952,910 A * 9/1960 Meohas ..... B26B 21/06 30/53
3,255,523 A * 6/1966 Robertson et al. ..... B26B 21/10 30/53
3,613,233 A * 10/1971 Lundell ..... B26B 21/12 30/30
4,037,322 A * 7/1977 Bresler ..... B26B 21/525 30/53
4,344,226 A * 8/1982 Blake, III ..... B26B 21/10 30/55
4,401,129 A * 8/1983 Luque ..... B26B 21/125 132/213.1
4,441,252 A * 4/1984 Caves ..... B26B 21/12 30/53
4,612,705 A * 9/1986 Althaus ..... B26B 21/10 30/53
4,630,365 A * 12/1986 Imaizumi ..... B26B 21/10 30/53
4,665,615 A * 5/1987 Martinez ..... B26B 21/10 30/53
4,920,644 A * 5/1990 LaGattuta ..... B26B 21/10 30/53
5,479,950 A * 1/1996 Andrews ..... B26B 21/10 30/32
5,649,364 A * 7/1997 Ilanlou ..... B26B 21/10 30/50
6,092,288 A * 7/2000 Adachi ..... B26B 21/10 30/53
6,094,820 A * 8/2000 Adachi ..... B26B 21/12 30/30
6,249,973 B1 * 6/2001 Hirano ..... B26B 21/12 30/55
6,438,847 B1 * 8/2002 Alsaifi ..... B26B 21/10 30/53
6,871,403 B2 * 3/2005 Clark ..... B26B 21/12 30/53
8,191,557 B2 * 6/2012 Saiki ..... B26B 21/12 132/200
8,806,760 B2 * 8/2014 Moons ..... B26B 21/12 30/53
10,449,683 B2 * 10/2019 Spencer ..... B26B 21/525
10,464,227 B2 * 11/2019 Brormann ..... B26B 21/10
2009/0235529 A1 * 9/2009 Ringart ..... B26B 21/12 30/30
2018/0117781 A1 * 5/2018 Gonterman ..... B26B 21/525

* cited by examiner

HAIR STYLING TOOL DEVICE

CROSS-REFERENCE TO RELATED APPLICATION

This application claims the benefit of provisional patent application Ser. No. 62/968,871 filed Jan. 31, 2020.

STATEMENT REGARDING FEDERALLY SPONSORED RESEARCH OR DEVELOPMENT

N/A

FIELD OF THE INVENTION

The present invention relates to a hair cutting or finishing tool, and in particular, to a haircut finishing or shaping tool for cutting, shaping, thinning and, or tapering hair including a contoured handle forming a sleeve and having a tension relief notch, razor cartridge support saddle pivotally attached to the handle, razor cartridge track formed by the saddle, razor cartridge removably slidable into the track and pivot support post for pivotally attaching the saddle to the handle.

BACKGROUND OF THE INVENTION

Scissors and razors are known in the art for cutting, shaping or otherwise finishing hair. Scissors are typically used to cut hair to the desired lengths while razors are used to shape, trim, remove bulk, thin or otherwise operate as a finishing tool for hair. When hair is cut with scissors it makes a blunt hair end. Whereas, a razor makes angled cuts that create pointed ends that can curl or shred the ends of the hair. In many cases, when finishing or shaping hair the stylist typically desires to cut blunt hair ends, shape hair, thin hair, remove bulk, taper hair or control the angle or length of cuts but find it difficult to do with predictability or control because it is difficult to hold and control a razor due to its small and thin designs. At the same time, the stylist desires to keep the razor close to the fingertips for better control, flexibility and maneuverability of the razor. In addition, a patron's neck often needs to be shaved for a clean look and many states do not allow direct contact of a razor with the neck. Unfortunately, there are no handles or tools known for reliably and effectively holding a razor sufficiently close to the fingertips for ideal control, precision, flexibility and maneuverability of the razor when shaping, thinning, cutting, trimming, tapering or otherwise finishing hair or shaving the neck.

A variety of handles or tools are known for holding a razor used in cutting head hair, however, they fail to provide the desired proximity of the razor to the fingertips of the stylist or individual for the desired control, precision, flexibility and maneuverability of the razor. For instance, U.S. Pat. No. 10,464,227 discloses a hairdressing razor for cutting hair having an elongated handle and a cutting head joined to the handle, wherein at least one blade holder for at least one blade is provided in the cutting head. In order to achieve an improved cutting result and a longer blade service life, the invention provides for the longitudinal axis of the blade to be arranged at an angle to the longitudinal axis of the cutting head. A single recess is provided on at least one longitudinal side of the cutting head into which recess a free cutting region of projects without extending beyond the longitudinal edge of the longitudinal side when a blade is located in the blade holder, and wherein a length of the recess is smaller than half the length of the longitudinal side and wherein a length of the free cutting region in the recess is smaller than 15 mm.

U.S. Pat. No. 10,449,683 discloses a razor comb hair tool and a kit containing the same are disclosed. Embodiments include an elongated guard member having an exterior with first and second opposing edges and a hollowed interior defining a cavity, wherein the first edge includes a plurality of spaced apart comb teeth and the second edge includes an opening allowing access to the cavity. A razor blade may optionally be positioned within the cavity. Embodiments also include a handle member adapted along a first edge to make a slidable connection with the second edge of the guard member. When the slidable connection is made, access to the opening and/or razor blade is obstructed.

U.S. Pat. No. 8,191,557, discloses a universal hair tapering razor for tapering hair includes a cutting blade portion, a shank portion and a handle portion, the cutting blade portion including blade means having a cutting blade with a cutting edge for tapering hair, tapering regulating means, and blade holding means having a flat portion which comes into close contact with the panel of hair to be tapered, with the cutting edge and the outer surface of the flat portion both being on an identical reference plane, and the cutting blade is disposed at a predetermined angle with respect to the reference plane, and the handle portion is disposed at a predetermined angle with respect to the cutting blade portion. There is also provided a universal hair tapering method of tapering hair that can create two or more different types of hairstyles as desired from one type of hair tapering, which method can be performed with this hair tapering razor, U.S. Pat. No. 6,871,403, discloses an improved hair razor includes a cylindrical barrel forming the first part of an elongated handle having a razor blade holder joined to one end thereof, a tubular member forming the second part of the elongated handle having a finger ring formed therein, and an armature means connecting other ends the first part and the second part of the elongated handle in axial alignment, the armature means operable to allow the first part and the second part to rotate relative to each other and selectively lock the first part and the second part against rotation at a plurality of positions. The multiple positions available for the finger ring orientation lessens fatigue and stress of beauticians and barbers using the novel razor U.S. Patent Publication No. 2018/0117781 discloses a razor assembly for shaving with an open palm includes a grip. The grip may be positioned in a palm of a hand thereby facilitating the grip to inhibit symptoms of tendonitis. A blade unit is removably coupled to the grip. Thus, the blade unit may shave hair.

The foregoing references fail to disclose a handle or tool for reliably and effectively holding a razor sufficiently close to the fingertips for ideal control, precision, flexibility and maneuverability of the razor when shaping, thinning, cutting, trimming, tapering or otherwise finishing hair. If such a razor handle or holding device existed, it would be well received. Unfortunately, there are no hair cutting, trimming, shaping, thinning, tapering or finishing tools known for keeping a razor proximal the fingertips for the desired control, flexibility and maneuverability without compromising a firm grip. As there are no hair razor handle or finishing tools that adequately or effectively address or resolve the aforementioned shortcomings in the hair styling industry, there exists a need for such a device. It is, therefore, to the effective resolution of the aforementioned problems and shortcomings of the prior art that the present invention is directed. The instant invention addresses this unfulfilled need in the prior art as contemplated by the instant invention disclosed.

SUMMARY OF THE INVENTION

In light of the foregoing, it is an object of the present invention to provide a hair cutting tool that can be used with one hand to conveniently cut hair at various angles with proficiency and accuracy.

It is also an object of the instant invention to provide a hair cutting tool that can be used with one hand to cut hair at various angle without the need for a finger aperture.

It is another object of the instant invention to provide a hair cutting tool that can be used to cut thin strands of hair more precisely.

It is an additional object of the instant invention to provide a hair cutting tool with an adjustable handle.

It is a further object of the instant invention to provide a hair cutting tool with an adjustable blade.

It is yet another object of the instant invention to provide a hair cutting tool with an adjustable blade cartridge.

It is yet a further object of the instant invention to provide a hair cutting tool that is easy to use.

It is yet an additional object of the instant invention to provide a hair cutting tool that can safely shave hair on the neck.

It is still another object of the instant invention to provide a hair cutting tool that can cut strands of hair without displacing or pushing aside adjacent or surrounding strands of hair.

It is still an additional object of the instant invention to provide a hair cutting tool that is cost effective for manufacturing and sale.

In accordance with one aspect, the present invention provides a hair cutting tool that can be used with one hand to conveniently cut hair at various angles with proficiency and accuracy without risk of injury to the user or customer and includes an ergonomically designed handle having a rail and a removable and interchangeable razor cartridge that slidably mounts to the handle railing. The handle has a tapered design with a slightly concave surface for firmly receiving a finger that allows for convenient manipulation of the hair cutting tool device. The edges of the handle and cartridge or preferably rounded or truncated to reduce risk of injury to the user or customer.

In another aspect, the present invention provides a mobile electronic device protective case including a housing. At least a portion of the housing includes a base portion for holding a mobile electronic device and a cover portion for enclosing the mobile electronic device in the base portion in a first position and providing access to the mobile electronic device in second and third positions. The cover portion provides a platform for supporting the base portion substantially upright in the second position or substantially flat in the third position. The platform includes a track with a plurality of ridges and slots for adjustably supporting the base portion substantially upright at a plurality of angles in the second position. A dual hinged linkage is pivotally connected to the cover portion and pivotally connected the base portion facilitating movement between the first, second and third positions.

In an additional aspect, the present invention provides a mobile electronic device protective case including a housing. At least a portion of the housing includes a base portion for holding a mobile electronic device and a cover portion for enclosing the mobile electronic device in the base portion in a first position and providing access to the mobile electronic device in second and third positions. The cover portion has an inside surface that supports the base portion substantially upright in the second position or substantially flat against an outside surface of the base portion in the third position. The cover portion includes an outside surface and a flexible handle connected to the outside surface for holding the case while in the third position. A dual hinged linkage is pivotally connected to the cover portion and pivotally connected the base portion facilitating movement between the first, second and third positions.

In accordance with these and other objects, which will become apparent hereinafter, the instant invention will now be described with particular reference to the accompanying drawings.

BRIEF DESCRIPTION OF THE DRAWINGS

A more complete understanding of the present invention, and the attendant advantages and features thereof, will be more readily understood by reference to the following detailed description when considered in conjunction with the accompanying drawings wherein.

DETAILED DESCRIPTION OF THE INVENTION

Figure 1:
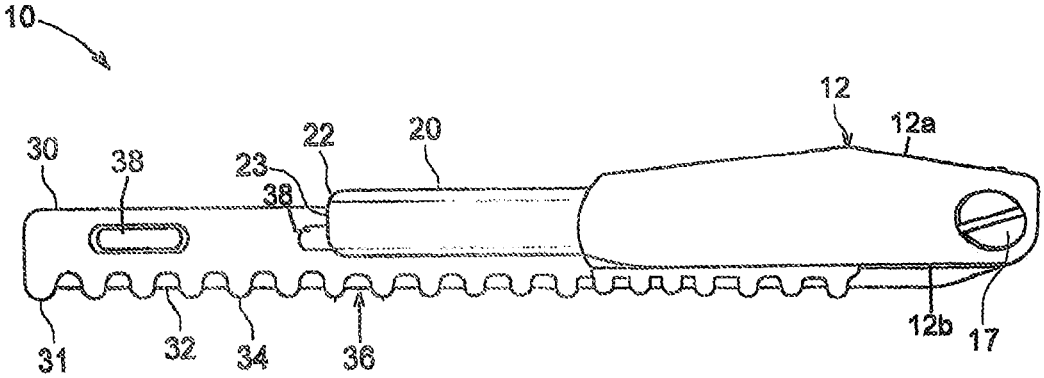
FIG. 1 is perspective view of the first embodiment of the hair styling tool device in a closed position with an extended length razor cartridge that extends beyond the razor cartridge saddle in accordance with the principles of the present invention in accordance with the instant invention.

With reference to the drawings in which like reference designators refer to like elements, FIGS. 1 to 13 depict the preferred and alternative embodiments of the instant invention which is generally referenced as a hair styling tool device, hair finishing tool, hair cutting tool, hair trimming tool, hair thinning tool, tool, device and, or by numeric character 10. There is shown in FIGS. 1-4 the preferred embodiments of the hair styling tool device 10 in accordance with the principles of the present invention. With reference to FIGS. 1-4, the hair styling tool 10 generally includes a handle 12, razor cartridge saddle 20 and razor cartridge 30. The handle 12 has an elongated "U" shape defining a closed edge 12*a* and an open edge 12*b* defining a saddle sleeve 14 for receiving and gripping the saddle 20 in the closed position and may have a contoured surface 13 for facilitating a better grip. The saddle 20 is pivotally connected to one end of the handle 12 by a post or rivet 17. The saddle 20 defines a smooth or closed surface 20*a* and an open top edge 20*b* that defines the track 22 for slidably receiving the razor cartridge 30. The razor cartridge 30 includes a frame 31 supporting a razor 32 and having a plurality of spaced prongs 34 separated at predetermined distances to define razor access openings 36. The edge of the razor 32 is recessed in the frame 31 and openings 36 for preventing inadvertent contact with the head or stylist's fingers so as to avoid injury. Although the prongs 34 are shown as being equally spaced, the width or angles of the openings 36 and, or prongs 34 may vary in accordance with the desired length or angle that the hair is cut, trimmed, or thinned. The frame 31 may be made from a plastic or plastic-like material that holds or contains the razor 32 which is exposed between the prongs 34. The handle 12 and saddle 20 each define apertures that line up when the saddle 20 is inserted in the handle track 14 for receiving and passing the post or rivet 17. The post 17 preferably defines a threaded post for receiving a securing screw 18 (shown in FIG. 9) from the opposite side of the handle 12. The saddle 20 is preferably made from a metal or metal-like material but may include or be made from other materials, such as plastic, PVC, wood, or plastic-like materials. The handle 12 is preferably made from a plastic or plastic-like material but may include or be made from other materials, such as metal, PVC, wood, or metal-like materials.

Figure 2:
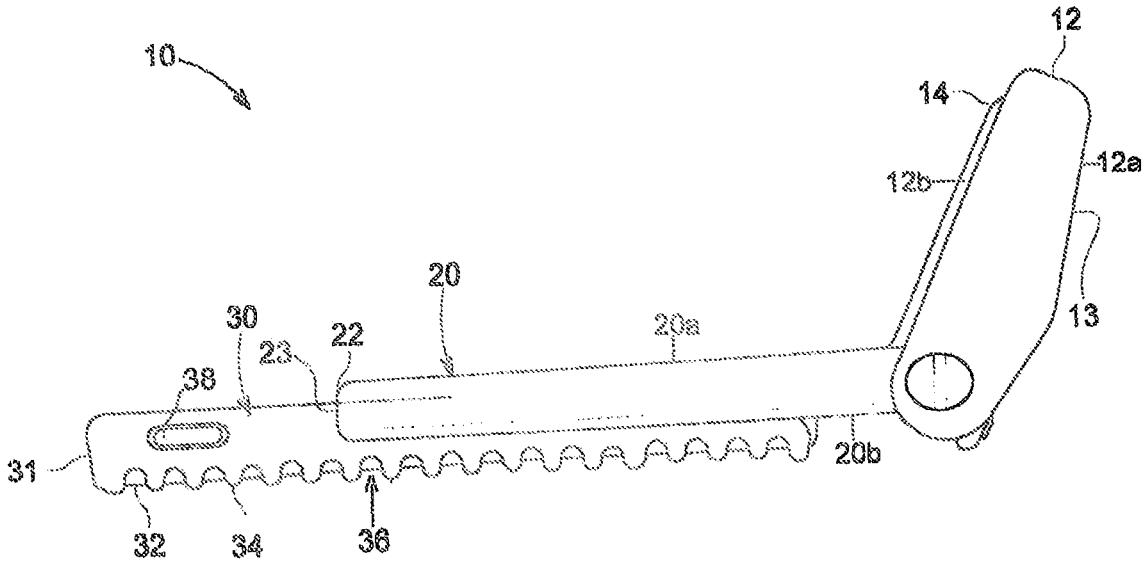
FIG. 2 is a perspective view of the hair styling tool device of FIG. 1 in an open position in accordance with the instant invention.
Figure 3:
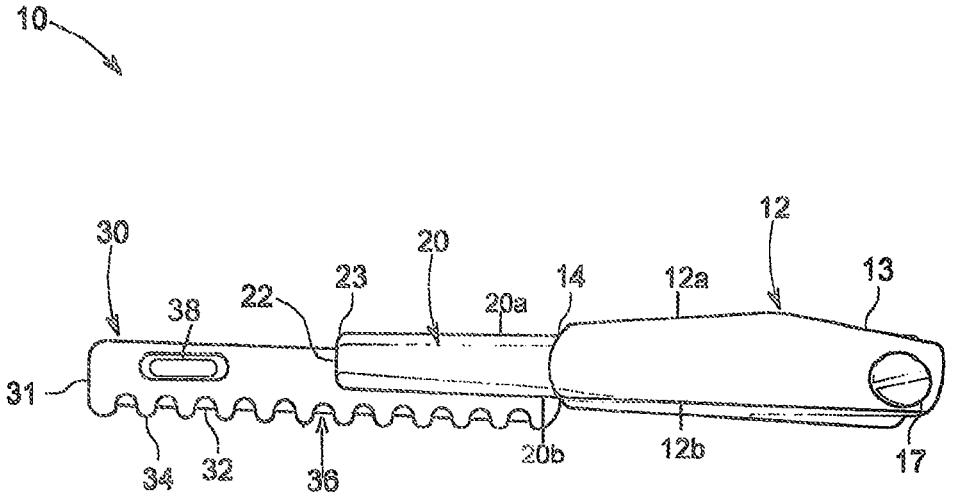
FIG. 3 is perspective view of the second embodiment of the hair styling tool device in a closed position with a standard length razor cartridge that extends beyond the razor cartridge saddle in accordance with the principles of the present invention in accordance with the instant invention.
Figure 4:
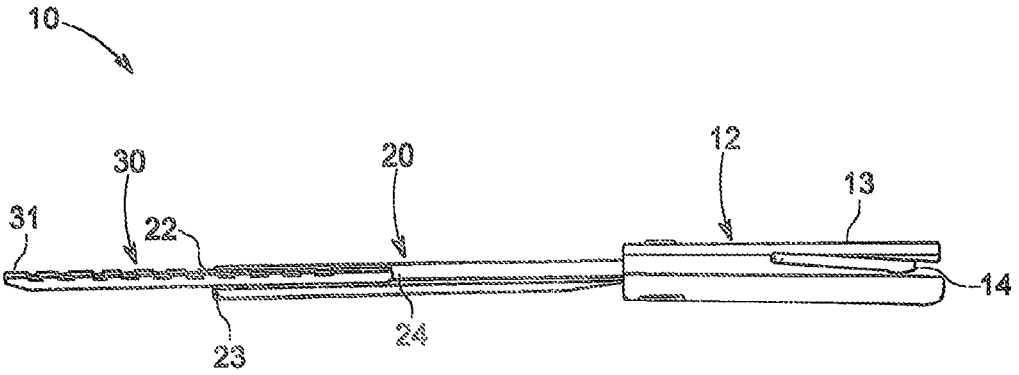
FIG. 4 is a perspective view of the hair styling tool device of FIG. 3 in an open position in accordance with the instant invention.

Still referring to FIGS. 1-4, the razor cartridge 30 in the preferred embodiments of the instant invention 10 has at least two different lengths both of which are designed to prevent the razor cartridge 30 from moving in the saddle 20 during use of the hair styling tool 10. With reference to FIGS. 1-2, in the first preferred embodiment of the hair styling tool 10 the razor cartridge 30 has an elongated or extended length that is longer than the saddle 20 such that the razor cartridge 30 extends beyond or past the free end 23 of the saddle 20. In this first preferred embodiment, the razor cartridge 30 may include a single uniform profile or two profiles joined together wherein one of the cartridges is a standard razor cartridge 30 available in the industry, such as the designing razors sold by Kasho. With reference to FIGS. 3 and 4, the razor cartridge 30 only partially penetrates the saddle 20 until it hits or abuts a barricade 24 such that the razor cartridge 30 extends beyond or past the free end 23 of the saddle 20. In this embodiment, the razor cartridge 30 preferably has a length that is approximately equal to or less than the length of the saddle 20. A screw or tab may project in the saddle sleeve 22 to engage and or intersect an aperture 38 defined in the razor cartridge 30 to secure it within the saddle 20 during use of the hair styling tool 10.

Figure 5:
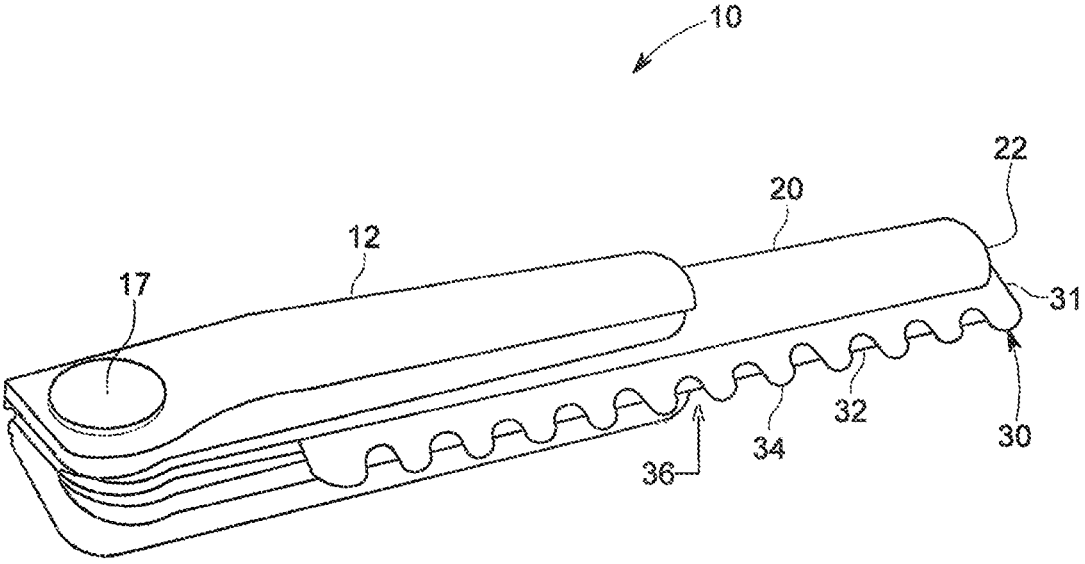
FIG. 5 is front perspective view of the third embodiment of the hair styling tool device in a closed position in accordance with the principles of the present invention in accordance with the instant invention.
Figure 6:
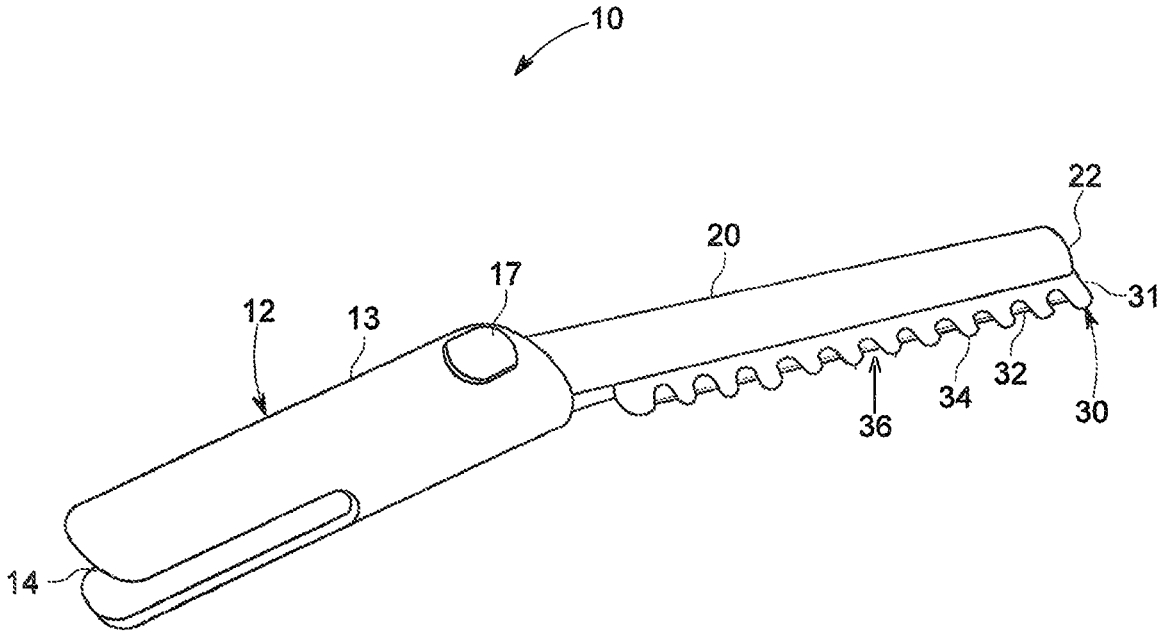
FIG. 6 is a perspective view of the hair styling tool device of FIG. 5 in an open position in accordance with the instant invention.

With reference to FIGS. 5-6, the third embodiment of the hair styling tool 10 generally includes a handle 12, razor cartridge saddle 20 and razor cartridge 30. The handle 12 has an elongated "U" shape defining a closed edge 12*a* and an open edge 12*b* defining a saddle sleeve 14 for receiving and gripping the saddle 20 in the closed position and may have a contoured surface 13 for facilitating a better grip. The saddle 20 is pivotally connected to one end of the handle 12 by a post or rivet 17. The saddle 20 defines a smooth or closed surface or edge 20*a* and open edge 20*b* that mates with the track 22 for slidably receiving the razor cartridge 30. The razor cartridge 30 includes a frame 31 supporting a razor 32 and having a plurality of spaced prongs 34 separated at predetermined distances to define razor access openings 36. The edge of the razor 32 is recessed in the frame 31 and openings 36 for preventing inadvertent contact with the head or stylist's fingers so as to avoid injury. Although the prongs 34 are shown as being equally spaced, the width or angles of the openings 36 and, or prongs 34 may vary in accordance with the desired length or angle that the hair is cut, trimmed or thinned. The handle 12 and saddle 20 each define apertures that line up when the saddle 20 is inserted in the handle track 22 for receiving and passing the post or rivet 17. The post 17 preferably defines a threaded post for receiving a securing screw 18 (shown in FIG. 5) from the opposite side of the handle 12.

Figure 7:
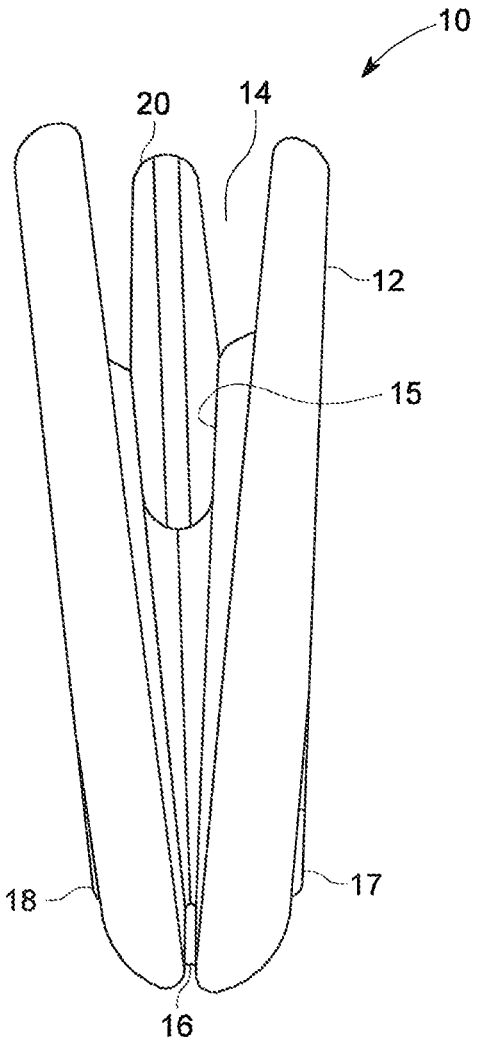
FIG. 7 is a plan view of the hair styling tool device in a closed position in accordance with the instant invention.
Figure 8:
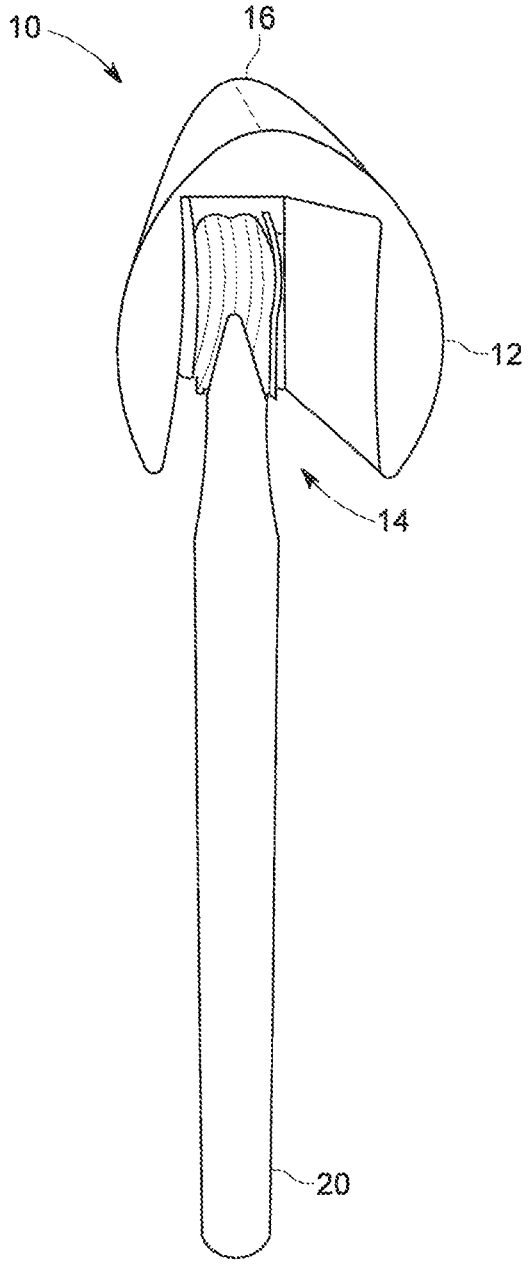
FIG. 8 is a plan view of the hair styling tool device in a partially open position in accordance with the instant invention.

Referring to FIGS. 7 and 8, in preferred and second and third embodiments the handle 12 defines the "U" shaped saddle sleeve 14 wherein the saddle 20 is pivotally connected to the handle 12 at one end (the pivot end) and pivots into the saddle sleeve 14 in the closed position outward in the open position. The styling tool device 10 may be used in either the closed or open position. The handle 12 defines a notch 15 at the end opposite the pivot end for expanding outward under pressure when the saddle 20 is moved into the handle sleeve 14 in the closed position while moving inward against the saddle 20 in the closed position for securing the saddle 20 in the handle 12. The handle 12 may also have a notch 16 proximal the pivot end 16 for facilitating smooth pivoting of the saddle 20. In an alternative embodiment, the handle 12 may be open along the edge opposite the saddle sleeve opening 14 for receiving the edge of the razor cartridge 30 for storage when not in use.

Figure 9:
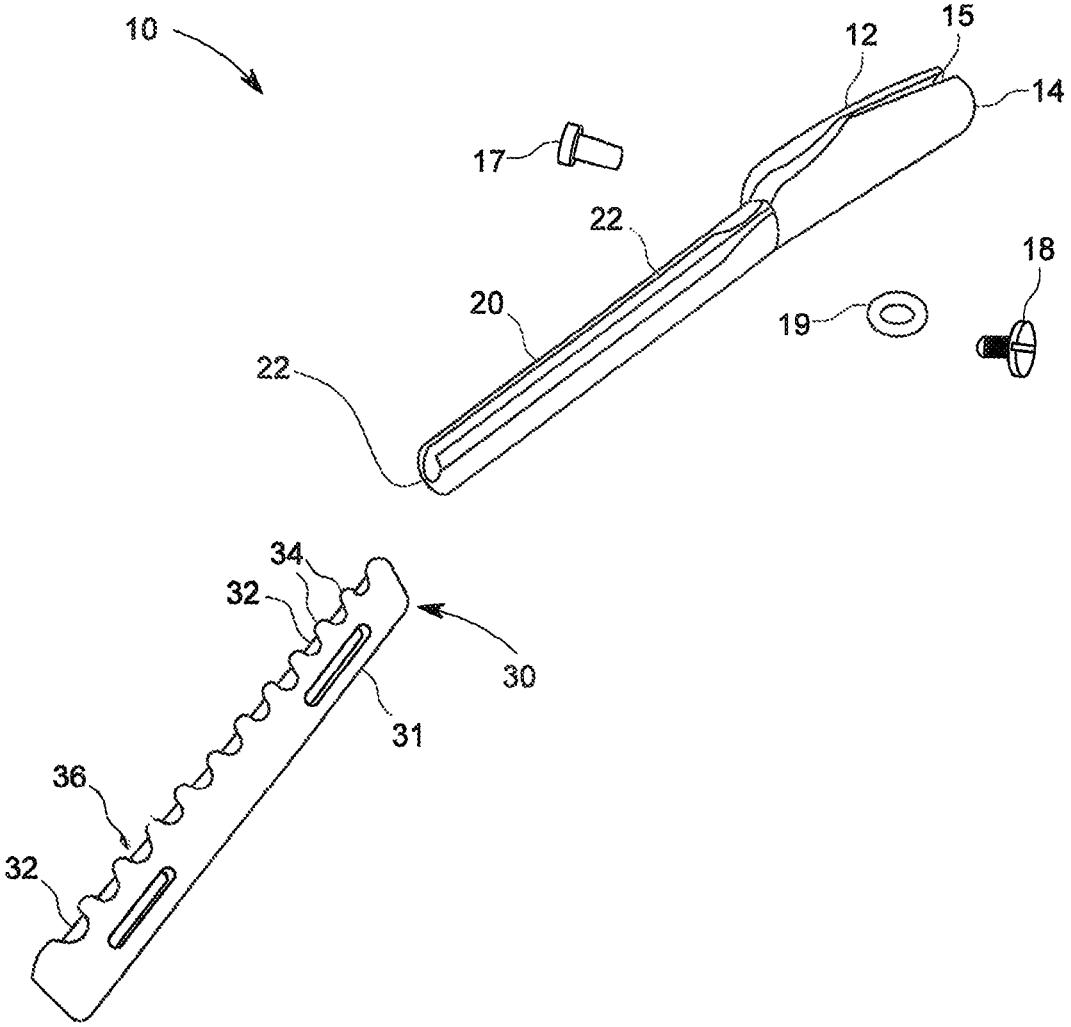
FIG. 9 is an exploded view of the hair styling tool device in an open position in accordance with the instant invention.
Figure 10:
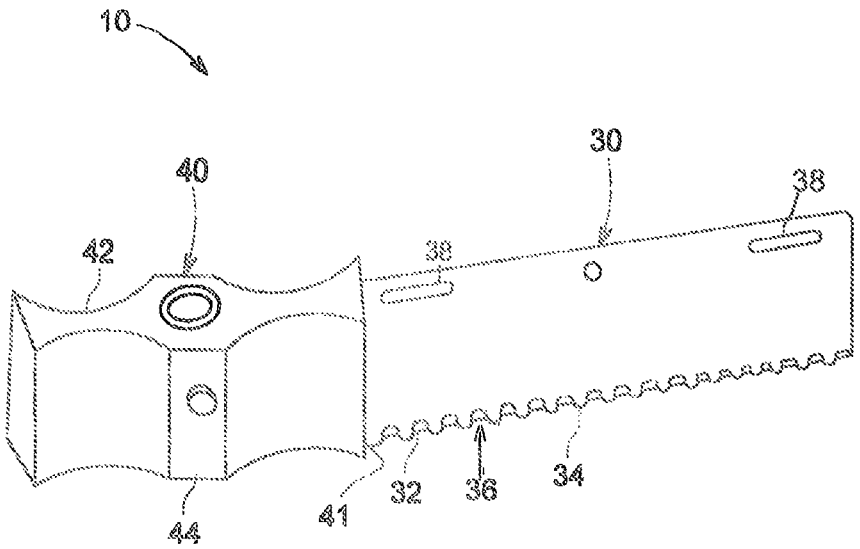
FIG. 10 is a perspective view of the fourth embodiment of the hair styling tool device with a razor cartridge extending from one end of a handle in accordance with the instant invention.
Figure 11:
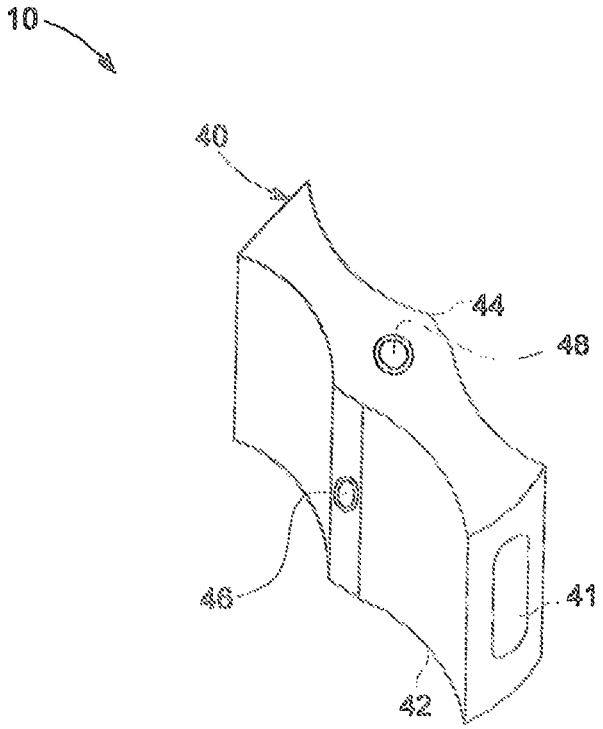
FIG. 11 is a perspective view of the handle of the fourth embodiment of the hair styling tool device shown in FIG. 10 in accordance with the instant invention.
Figure 12:
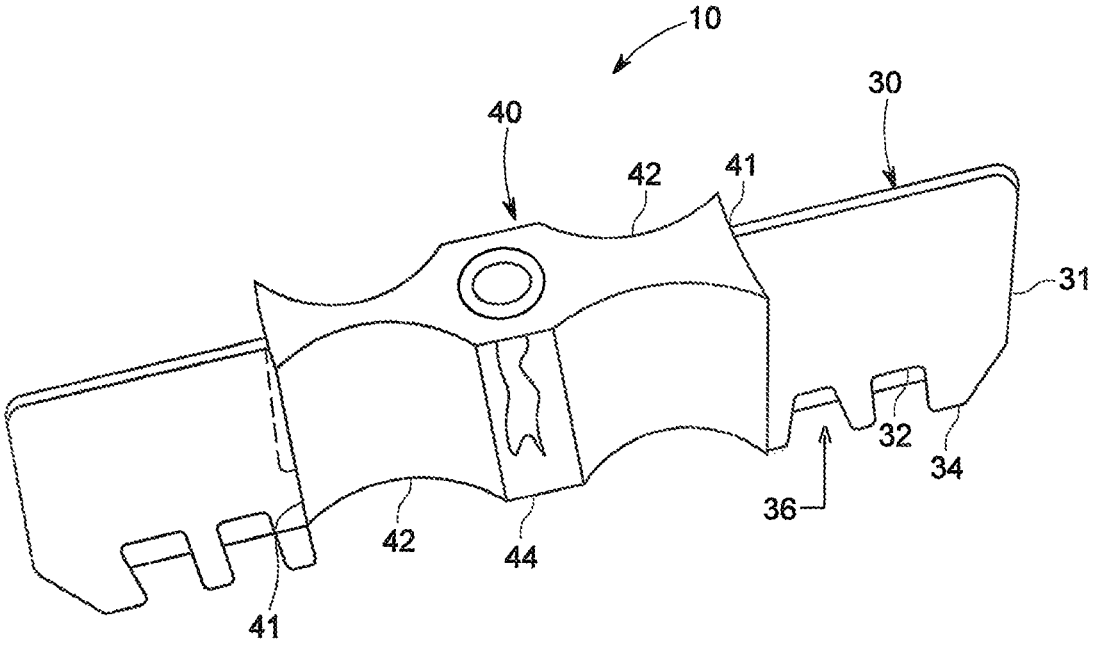
FIG. 12 is a perspective view of the fifth embodiment of the hair styling tool device with a razor cartridge extending from both ends of a handle in accordance with the instant invention.
Figure 13:
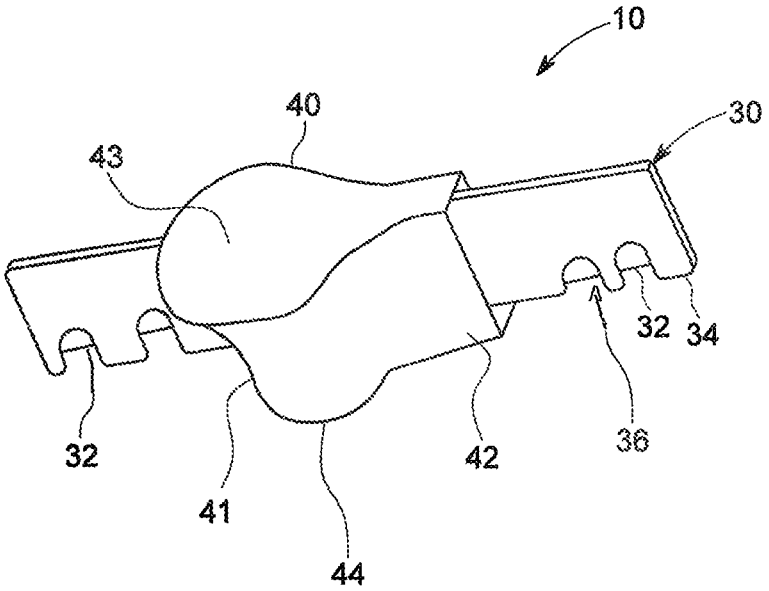
FIG. 13 is a perspective view of the handle of the sixth embodiment of the hair styling tool device in accordance with the instant invention.

Referring to FIG. 9, an exploded view of the hair styling tool 10 is shown. The pivot end of the saddle 20 has an aperture and the handle 12 has corresponding aligned apertures defined in the walls of the handle 12 for receiving the threaded post 17 and screw or bolt 18 to secure the saddle 20 in and to the handle 12. The invention 10 may include washers or bushings 19 for stability of the saddle 20 when it is pivoted. The washers are preferably metal, or plastic and the bushings are preferably rubber or rubber like. The razor cartridge 30 slides into the saddle track 22 for use and may be slidably removed for inserting a new or different cartridge 30 having different spacing parameters for a different cut.

Referring to FIGS. 1-5, the handle 12 may have a contoured surface 13 for enhancing the grip and is preferably made from a durable smooth plastic or plastic like material. The saddle 20 is made from a metal or metal like material but may be made from a durable plastic. The cartridge frame 31 is preferably made from a plastic or plastic like material while the razor 32 is metallic. The cartridge frame 31 may be made from a metal or metal like material in an alternative embodiment.

Referring to FIG. 6, the alternative embodiment of the instant invention 10 includes a fixed handle or grip 40 and razor cartridge 30. The razor cartridge 30 includes a frame 31 supporting a razor 32 and having a plurality of spaced prongs 34 separated at predetermined distances to define razor access openings 36. The edge of the razor 32 is recessed in the frame 31 and openings 36 for preventing inadvertent contact with the head or stylist's fingers so as to avoid injury. Although the prongs 34 are shown as being equally spaced, the width or angles of the openings 36 and, or prongs 34 may vary in accordance with the desired length or angle that the hair is cut, trimmed or thinned. The grip 40 defines a sleeve 41 for receiving and securing the razor cartridge 30 and at least one beveled surface 42 on at least one side of the grip 40 that also defines a grasp ridge or riser 44 to press a finger or thumb against during use. The sleeve 41 may include at least one notch and, or pin or nob for securing the razor cartridge 40 in the grip 40 in a way that prevents slipping during use. The grip 40 preferably has dual beveled surfaces 42 on opposites of the grip 40 that define a raised ridge 44 on both sides of the grip 40 for facilitating the pressing or support of a fingertip or thumb-tip on or against the ridge 44 during use. The dual beveled edges on both sides of the grip 40 enable the hair styling tool 10 to be turned or flipped for use in either direction or side or from any direction or angle which may be especially useful for razor cartridges 30 that have razor access openings 36 and, or prongs 36 of different widths for varied cuts.

Referring to FIG. 7, the other alternative embodiment of the instant invention 10 includes a fixed handle or grip 40 and razor cartridge 30 wherein the razor cartridge 30 includes a frame 31 supporting a razor 32 and having a plurality of spaced prongs 34 separated at predetermined distances to define razor access openings 36 with the edge of the razor 32 being recessed in the frame 31 and openings 36 and the grip 40 defines a sleeve 41 for receiving and securing the razor cartridge 30, at least one side beveled surface 42 on at least one side of the grip 40 that also defines a grasp ridge or riser 44 to press a finger or thumb against during use and a top beveled surface 43 for pressing a thumb or finger during use. Although the prongs 34 are shown as being equally spaced, the width or angles of the openings 36 and, or prongs 34 may vary in accordance with the desired length or angle that the hair is cut, trimmed or thinned. The sleeve 41 may include at least one notch and, or pin or nob for securing the razor cartridge 40 in the grip 40 in a way that prevents slipping during use.

With reference to FIGS. 1-13, the hair design tool 10 may include a variety of designs and materials. The handle 12 may include graphics, a logo, or other image or images on its surface or surfaces. For instance, it could be a company name or logo, team name, team logo, cartoon graphic or any other graphic. The handle 12 may include a three-dimensional design such as a skull, helmet, or other design so long as it is able to support the razor cartridge 30. The saddle 20 may be made from a metal, metal composite, plastic, plastic composite or metal and plastic composite material, Likewise, the handle 12 could be made from a plastic, plastic composite, metal, metal composite or plastic-metal composite material. The dimensions of the hair design tool 10 may vary but is typically a size that conveniently fits in the average person's hand.

It will be appreciated by persons skilled in the art that the present invention is not limited to what has been particularly shown and described herein above. In addition, unless mention was made above to the contrary, it should be noted that all of the accompanying drawings are not to scale. A variety of modifications and variations are possible in light of the above teachings without departing from the scope and spirit of the invention, which is limited only by the following claims.

What is claimed is:

1. A hair styling tool device, said device comprising:
a handle having a free end and a pivot end;
a razor saddle pivotally connected to said handle, said saddle defining a pivot end pivotally connected to said handle pivot end, a saddle sleeve, and a free end; and
a razor cartridge slidably insertable into said saddle sleeve, said razor cartridge including a frame supporting a razor recessed in said frame and having a plurality of spaced prongs separated at predetermined distances to define razor access openings wherein an edge of the razor is recessed in said frame and openings for avoiding inadvertent contact with the head or stylist's fingers, said razor cartridge having a length that is longer than said razor saddle.

2. The device of claim 1, wherein said handle comprises:
a handle channel having at least a partially closed edge and an open edge for receiving said saddle.

3. The device of claim 2, wherein said saddle comprises:
a smooth or closed edge that mates with said handle channel when said handle is pivoted toward and over said saddle.

4. The device of claim 3, wherein said handle pivots over said saddle closed edge.

5. The device of claim 1, wherein said handle comprises:
a contoured surface for facilitating a better grip.

6. The device of claim 1, wherein said saddle comprises:
a barrier defined in said saddle sleeve for engaging said razor cartridge to prevent full penetration into said saddle sleeve so as to facilitate said razor cartridge extending outside said saddle and past said saddle free end for facilitating cutting thin strands of hair.

7. The device of claim 1, wherein said razor cartridge comprises:
a length that extends outside said saddle and past said saddle free end.

8. The device of claim 1, wherein said handle comprises:
a handle channel defined by at least a partially closed edge and open edge.

9. A hair styling tool device, said device comprising:
a handle defining a handle channel having a closed edge and an open edge for receiving said saddle;
a razor saddle pivotally connected to said handle, said saddle defining a pivot end pivotally connected to said handle, a saddle sleeve, and a free end, said handle channel receiving said saddle when said saddle and handle are pivoted toward each other;
a razor cartridge slidably insertable into said saddle sleeve, said razor cartridge including a frame supporting a razor recessed in said frame and having a plurality of spaced prongs separated at predetermined distances to define razor access openings wherein an edge of the razor is recessed in said frame and openings for preventing inadvertent contact with the head or stylist's fingers;
a barrier defined in said saddle sleeve for engaging said razor cartridge to prevent full penetration into said saddle sleeve so as to facilitate said razor cartridge extending outside said saddle and past said saddle free end for facilitating cutting strands of hair;

said saddle including a smooth or closed edge that mates with said handle channel when said handle is pivoted toward and over said saddle; and said saddle sleeve defining a saddle channel for slidably receiving said razor cartridge, said saddle channel having a closed edge and an open upper edge for allowing a portion of said razor cartridge to project outside said saddle.

10. The device of claim 9, wherein said handle comprises:

a contoured surface for facilitating a better grip.

11. The device of claim 9, wherein said razor cartridge comprises:

a length that extends outside said saddle and past said saddle free end.

12. The device of claim 9, wherein said razor cartridge comprises:

a length that is longer than said saddle.

13. The device of claim 9, wherein said saddle includes a metal material and said handle includes a plastic material.

* * * * *